US006155994A

United States Patent [19]

Hubbard et al.

[11] Patent Number: 6,155,994

[45] Date of Patent: Dec. 5, 2000

[54] METHODS AND EQUIPMENT FOR TREATING OR PREVENTING MUSCLE PAIN OR INJURY

[75] Inventors: David R. Hubbard; Paul Johnson, both of La Jolla, Calif.

[73] Assignee: Myopoint, Inc., La Jolla, Calif.

[21] Appl. No.: 09/327,207

[22] Filed: Jun. 7, 1999

Related U.S. Application Data

[63] Continuation-in-part of application No. 08/812,260, Mar. 6, 1997.

[51] Int. Cl.[7] ..... A61H 1/02

[52] U.S. Cl. ..... 601/5; 601/26; 601/33; 601/91; 601/93; 601/98; 482/134

[58] Field of Search ..... 601/5, 23–6, 33, 601/40, 90–93, 98, 101; 482/134, 142, 148, 907, 92

[56] References Cited

U.S. PATENT DOCUMENTS 1,527,754 2/1925 Simon .
2,644,447 7/1953 Sanders .
3,769,636 11/1973 Friedman .
5,158,074 10/1992 Grellas .
5,242,356 9/1993 Grenfell .
5,487,590 1/1996 Haynes .
5,496,246 3/1996 Pierre .
6,027,432 2/2000 Cheng .

*Primary Examiner*—Danton D. DeMille
*Attorney, Agent, or Firm*—Lyon & Lyon LLP

[57] ABSTRACT

Machines for treating neuromuscular pain conditions and injuries by slow patient-controlled stretching of a muscle or group of muscles when they and surrounding muscles are in a relaxed state (i.e., with little or no extrafusal muscle fiber contractions). The machines include a fixed support such as seat. An adjustable support, such as a back or side rest is adjusted for the particular patient. A controllable support moved in an alternating motion, under the patient's control, allows the injured or painful muscle to be slowly stretched by gravity, while the muscles are relaxed. The controllable support is preferably moved by a hydraulic cylinder.

13 Claims, 15 Drawing Sheets

98
98
62
90
110
78
44
3
3
θ
θ
64

150
147
142
150
151
148
140
154
146
136
162
137
138
141
135
149
170
152
134
90
168

METHODS AND EQUIPMENT FOR TREATING OR PREVENTING MUSCLE PAIN OR INJURY

This application is a continuation-in-part of Ser. No. 08/812,260, incorporated herein by reference, filed Mar. 6, 1997, and now pending.

BACKGROUND OF THE INVENTION

The field of the invention is apparatus and methods for treating muscles and neuromuscular pain conditions.

Muscle injuries and pain, common among athletes and manual laborers, occur in the general population, due to accidents, over-exertion, and/or poor ergodynamic and working conditions. These types of injuries occur often in the neck, arms, hip, back, and shoulders.

Traditional therapies, such as in muscle strengthening, the most common approach to physical therapy, have no proven effect and often aggravate the pain. Other techniques such as heat or ultrasound are passive and also unproven. Active stretching of the muscle is more effective but has been traditionally performed by physical manipulation of the patient by the therapist, often resulting in over-stretch and a reaction of muscle tightening.

When a muscle is acutely strained, as in a lifting injury, there is pain in the injured muscle until tightness, swelling, bleeding and inflammation subside. Muscles surrounding the injured area tighten up in order to splint the site and prevent further damage, and these surrounding muscles also become painful. In addition, the muscle stretch receptors, called muscle spindles, become contracted. This spindle spasm can become chronic if tension co-exists causing a sympathetically-mediated activation of the spindle.

SUMMARY OF THE INVENTION

It has now been discovered that, in contrast to prior physical therapy practices which emphasize muscle strengthening and/or active stretching, muscle injury and pain conditions are more effectively treated by using body weight and gravity to stretch, preferably slowly stretch, the injured or painful muscle while surrounding muscles are maintained in a generally relaxed state. This is accomplished by placing the body in such a position that muscles other than the muscle to be treated are relaxed while the injured or painful muscle, for example, is placed in such a position that body weight, optionally assisted by the addition of further weight, can be used to accomplish the treatment stretch. This is preferably accomplished with novel equipment designed to promote this gravity or relaxed stretching. Examples of such equipment are described and claimed herein. This equipment also preferably includes a means for allowing the stretch to be accomplished slowly and for returning the stretched muscle to the starting position without voluntarily contracting said muscle. The muscle injury prevention and therapy machines described herein offer an appropriate amount of muscle stretch, to reduce the risk of reinjury and provide longer lasting relief, and accelerated patient improvement. The patient, via actuators on the machines, can control the degree of stretch on the affected muscle and then return to a neutral position, while maintaining a relaxed state in a gravity-dependent position. By providing for the addition of further weight, in the form of independent weight devices (such as weighted pads), or a means for adding a weight or weights to the equipment itself (such as by a tubular bar for holding barbell-type weights, secured to that portion of the equipment which moves to permit the stretch) and a means for securing the muscle to be treated to the equipment (such as by a strap), the gravity stretch may be enhanced.

BRIEF DESCRIPTION OF THE DRAWINGS

In the drawings, wherein similar reference denote similar elements throughout the several views.

DETAILED DESCRIPTION OF THE PREFERRED EMBODIMENTS

The most effective therapy for muscle injury and pain involves the slow gentle stretching of the involved muscle or group of muscles while they and surrounding muscles are in a state of muscle relaxation, such that there are little or no extrafusal muscle fiber contractions. While traditional methods of therapy have sometimes included stretching, the stretching has typically been 1) controlled by the therapist, not the patient; or 2) has involved contraction of the surrounding muscles, especially the antagonist muscles, e.g., stretching the back extensors by actively (voluntarily) contracting the back flexors (abdominal muscles); or 3) has used too rapid a stretch; or 4) has required active contraction to restore the patient to the original non-stretched position; or 5) was directed to achieving excessive stretch rather than conscious patient perception of changes in degree of muscle stretch. The following machines and methods achieve slow gentle stretching of specific muscles or groups of muscles, with the muscles in a relaxed condition while in a gravity-dependent position, thereby achieving highly effective therapy. The following machines and methods can also be used for warm-up stretching before exercising, to reduce the risk of muscle injury during exercise.

Figure 1:
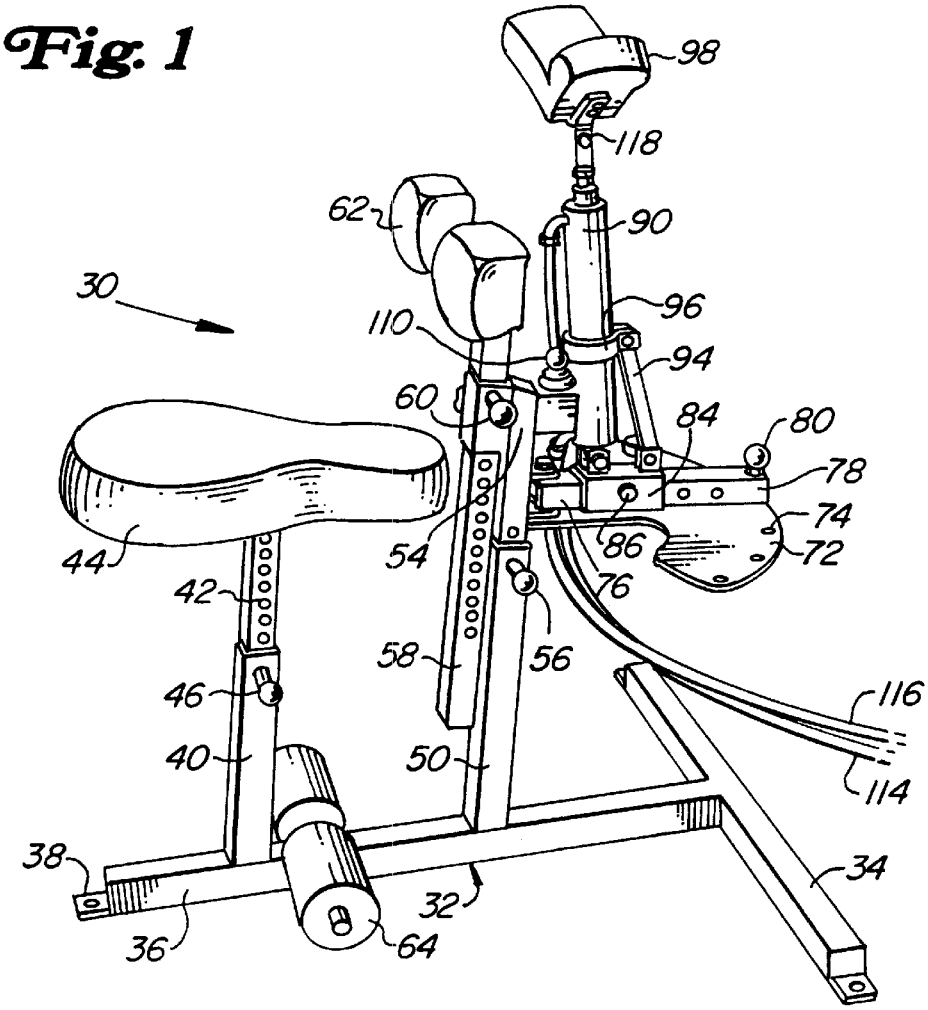
FIG. 1 is a perspective view of a first embodiment of the prevent invention useful, for example, for neck flexion treatment.
Figure 2:
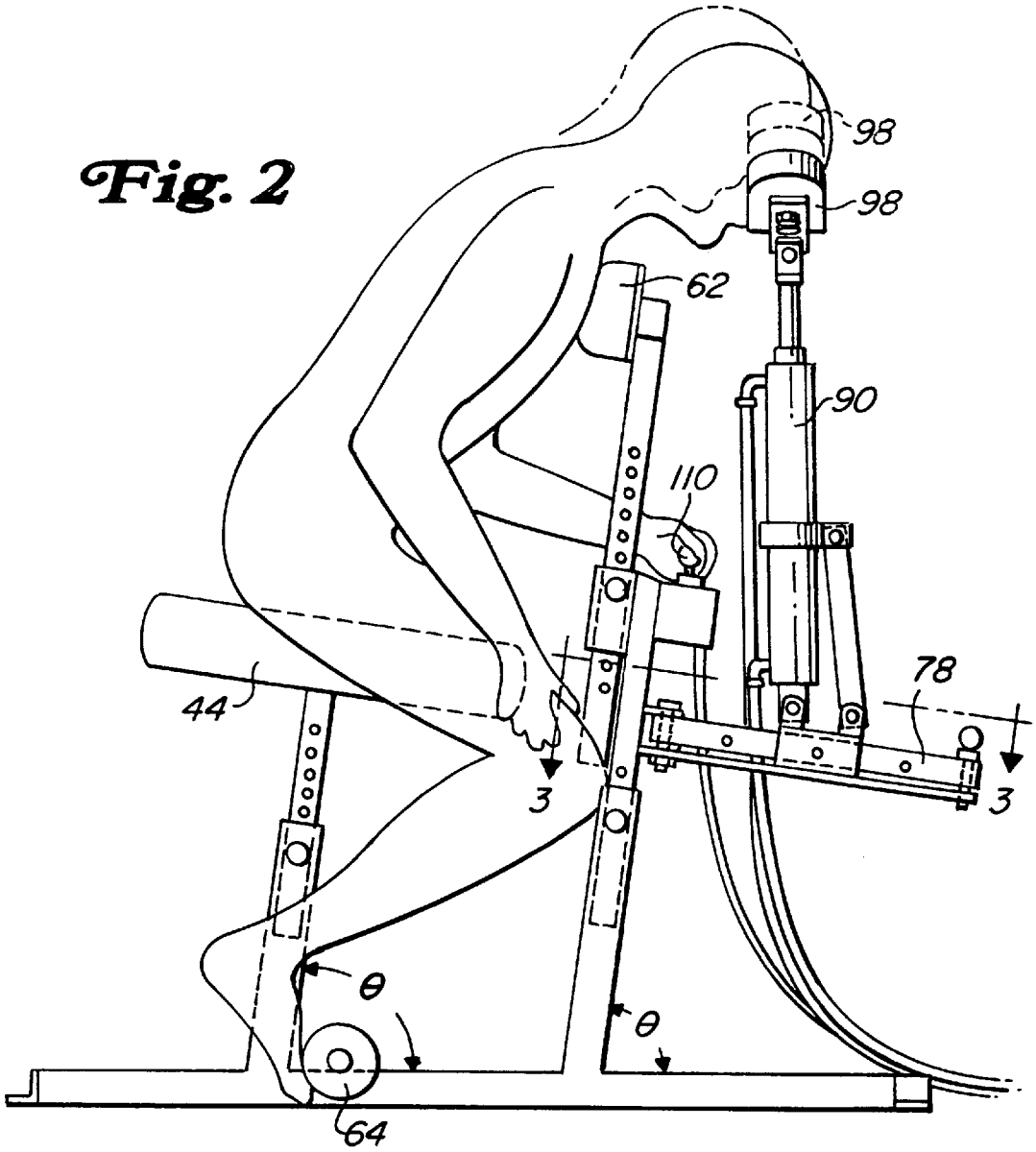
FIG. 2 is a side elevation view thereof illustrating the machine of FIG. 1 in use.

Turning now in detail to the drawings, as shown in FIGS. 1 and 2, the first embodiment 30 includes a T-shaped base 32 having a cross beam 34 attached perpendicularly to a main beam 36. Mounting holes or brackets 38 are provided on the base 32. A hollow seat pipe 40 extends vertically upwardly from the main beam 36. A seat 44 having a seat post 42 with through holes is placed in the seat pipe 40 and secured in position via a lock pin 46.

Figure 3:
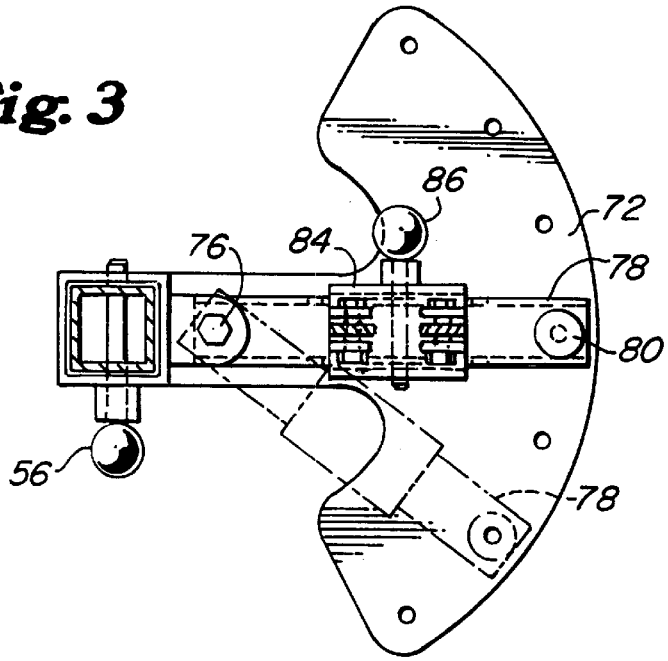
FIG. 3 is a partial section view taken along line 3—3 of FIG. 2.

Similarly, a support riser 54 with through-holes can be vertically raised or lowered in a riser pipe 50 via a riser pin 56 extending through the riser pipe 50 and a riser section 54. A torso bar 58 is similarly vertically adjustable on the riser 54 via torso bar pin 60 extending through holes in the torso bar 58. Torso pads 62 are attached at the upper end of the torso bar 58. Foot pads 64 are attached to the main beam, just froward of the seat pipe 40. Referring now to FIGS. 1 and 3, the arm 78 is pivotally attached the riser 54 through a hinge joint 76. An (azimuth) angle plate 72 is joined to the riser 54. As shown in FIG. 3, the angle plate 72 has a plurality of spaced apart holes 74, allowing the arm 78 to swing arc-like in either direction, and be locked at any particular angle by an arm pin 80 extending through a hole 74 in the angle plate 72 and into the arm 78. Referring to FIG. 2, the seat pipe 40 and riser pipe 50 are inclined at angle Θ, ranging from about 70° to 88°, and more preferably about 82°, forwardly, (towards the end of the machine at the cross beams 34).

As best shown in FIG. 2, the lower end of an actuator, such as hydraulic cylinder 90, is pivotally attached to a collet 84 slidably positioned over the arm 78. Other actuators including electric, pneumatic, mechanical, etc. may also be used. The collet can slide in and out on the arm 78, to shift the position of the lower end of the hydraulic cylinder 90 towards and away from the patient. A collet pin 86 extending through the collet 84 and arm 78 locks the lower end of the hydraulic cylinder into a desired position on the arm 78. An angle linkage 94 and a clamp ring 96 are used to adjust and hold the inclination angle of the hydraulic cylinder toward the patient.

Hydraulic supply and return lines 114 and 116 extend from a hydraulic system (not shown) to a counter-balance valve 112 connecting to the hydraulic cylinder 90. The counter-balance valve 112 is controlled by hand control 110. A headpiece 98 is attached to the upper end of the hydraulic cylinder 90 via a swivel joint 118. The swivel point allows the headpiece 98 to be moved into a desired position.

The embodiment shown in FIGS. 1–3 is intended for treatment of neck pain, cervical strain, and whiplash. It is also be useful for treating tension headache and myofascial pain syndrome. It can work on the sternocleidomastoids, splenius, levator scapulae and trapezium muscles. It can also be modified for treatment of other muscles. In use the patient adjusts the seat height, angle (if any) of the arm 78, height of the torso pads 62, and position of the base of the hydraulic cylinder 90 attached to collet 84, by using the lock pins provided for each of those functions. The patient may also slide close to or away from the torso bar 58, because of the extended seat length. The vertical position of the arm 78 is preferably adjusted by a technician.

The patient rests the forehead on the headpiece 98 and places the hands on the hand controls 110. A variety of headpieces 98 are preferably provided, to match the patient and application. The headpieces 98 may be, for example, pillow, keyhole, or banana-shaped. The patient adjusts the position of the headpiece 98 and then locks it in position by placing weight of the head on headpiece 98. With the patient in the starting position, as shown in phantom in FIG. 2, and with the machine 30 appropriately set, the patient actuates the hand control 110 to retract and lower the piston 92 into the hydraulic cylinder 90, to a neutral position, between the anticipated full extension and full retraction positions for desired stretch. One technique is for the patient to stay in the stretch position for one slow inhale and exhale. This technique promotes awareness of the state of muscle stretch. After achieving a relaxed stretch, the patient reverses direction and, using the hand control 110, causes the piston 92 to extend back to its original position. The patient may perform these steps as often as desired. The movement of the patient's head and neck are shown in FIG. 2. The patient remains seated at all times.

With the arm 78 straight ahead (at 12 o'clock) the motion is pure forward flexion (the C-4 to C-7 vertebrae). If the base of the piston is changed to about 70 degrees and extended away from the patient by approximately 3–6 inches, the forward flexion will be from the T-4 to C-4 vertebrae. If the arm 78 is swung out to one side by about 20 degrees, as shown in phantom in FIG. 3, then the rotational and extensor muscles of the neck are also stretched.

The degree and speed of lowering and raising is under patient control. The stretch protocol can be progressed incrementally over time, with the patient advantageously working from a guideline for each week, based on past progress. The speed of actuator movement (in all embodiments) is from about 0.1–2.0 about inches/second and preferably about 0.5 inches/second.

Figure 4:
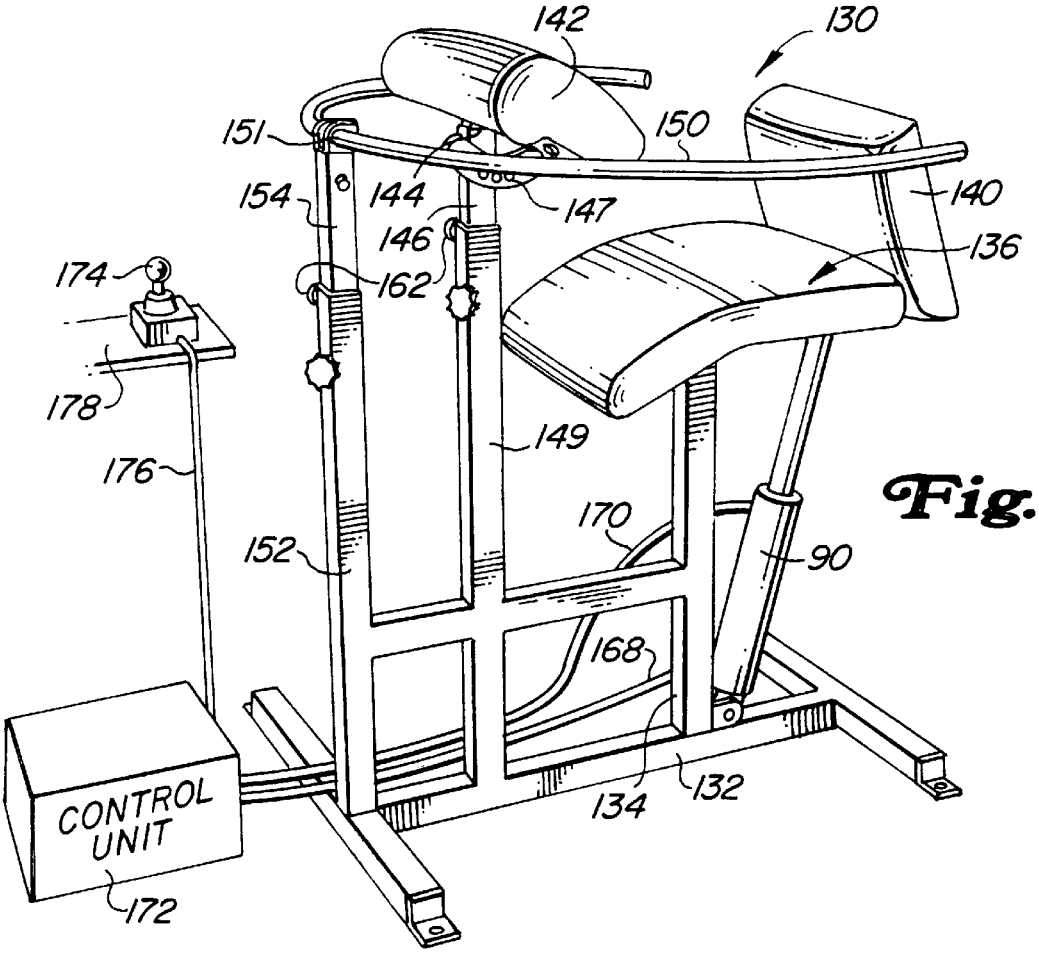
FIG. 4 is a perspective view of a second embodiment of the invention, useful, for example, for treatment of the quadratus lumborum.
Figure 5:
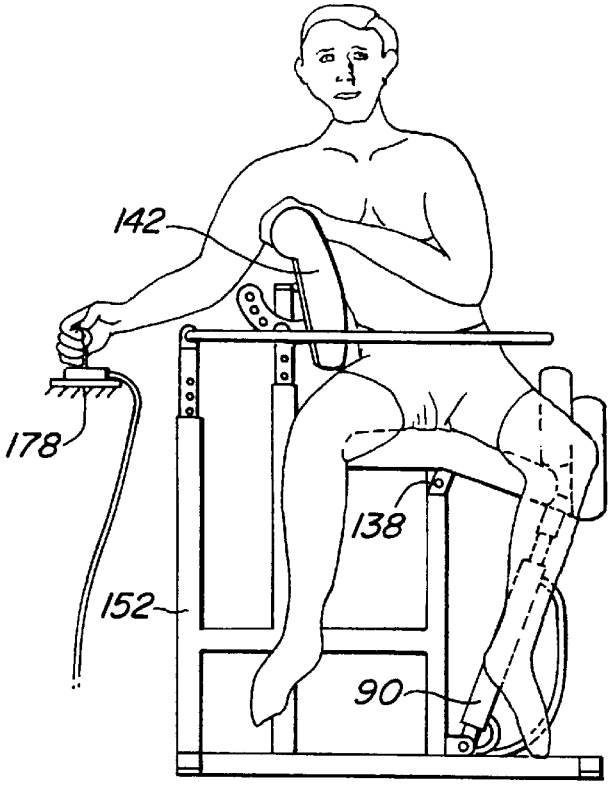
FIG. 5 is a front elevation view thereof.
Figure 6:
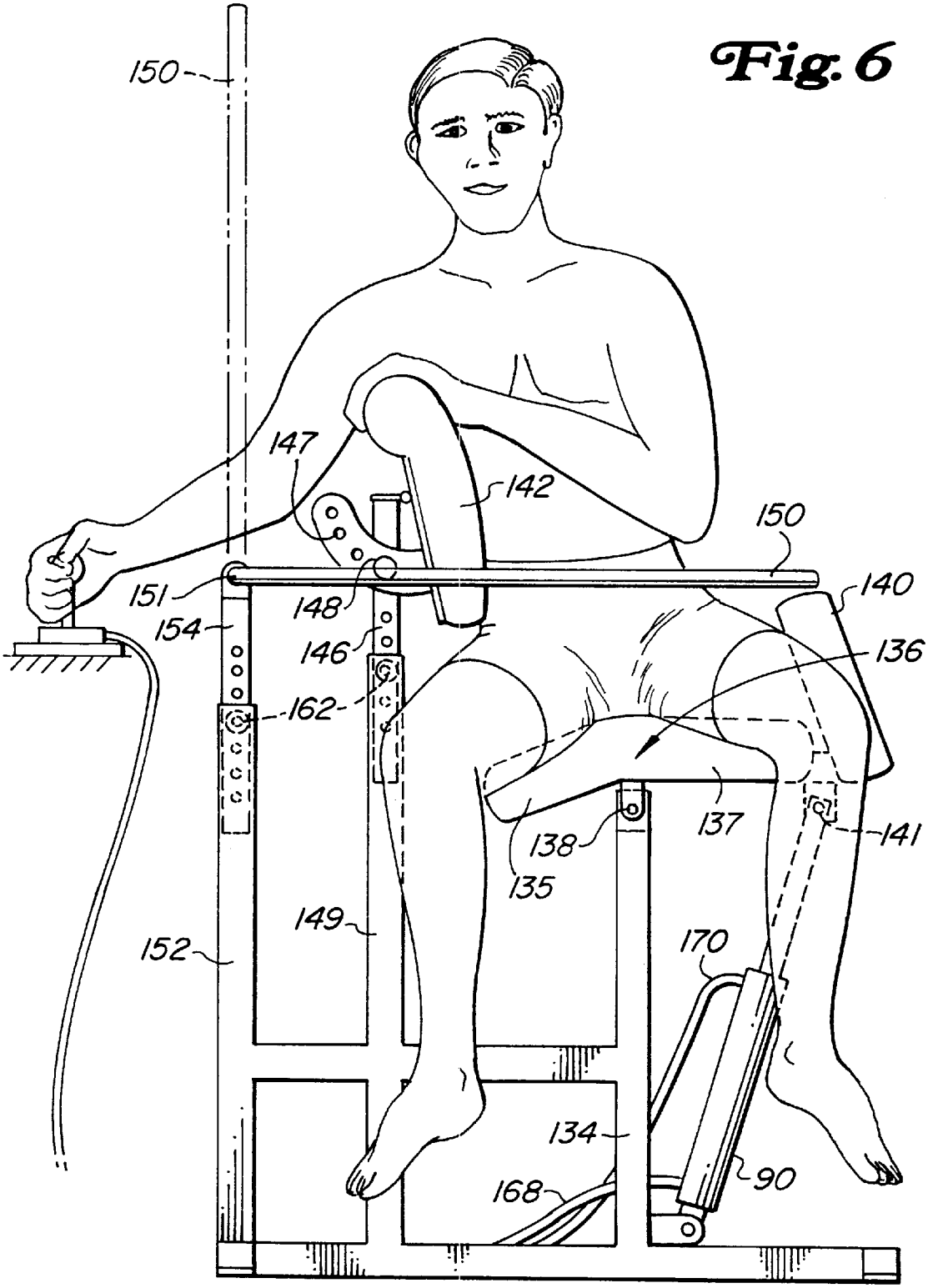
FIG. 6 is an enlarged front elevation view showing of the machine of FIGS. 4 and 5 in use.

As shown in FIGS. 4 and 5, a machine 130 useful for quadratus lumborum treatment includes a base 132, a seat tube 134 attached to the base 132, and a seat 136 pivotally attached on top of the seat tube 134 via a pivot joint 138. The seat has an inner section 135 set as an angle to an outer section 137. A seat end 140 is attached to the outer seat section 137. A linear actuator, e.g., a hydraulic cylinder has a lower end pivotally attached to a mount on the base 132, and an upper end pivotally attached to an extension mount on the seat end 140 with an eyelet and clevis pivot 141 (FIG. 6). Hydraulic lines 168 and 170 connect the hydraulic cylinder to a control unit 172. A hand controller 174 on a platform 178 is connected to the control unit 172 via control line 176. The controller 174 preferably is provided in the form of a joystick moveable between up and down positions, through a center neutral or stop position. The actuator is stopped unless the patient moves the joystick out of the stop position. The platform 178 may be attached to the handle tube 152.

A handle riser 154 with through-holes is vertically adjustable via a pin 162 within a riser tube 152 attached to the base 132. A side support pad 142 is pivotally attached to a riser pad mounting bar 146 with through-holes vertically positionable within a side pad tube 149. The side support pad is above and laterally off to one side of the seat 136. An angle plate 147 and pin 148 (FIG. 6) allows the side support pad 142 to pivot to various angles. A semi-circular handle bar 150 extends around either side of the seat 136. The handle pivots up on a handle pivot joint 151, and is attached to riser support bar 154.

The embodiment shown in FIGS. 4–6 is primarily intended for treatment of lower back including the quadratus lumborum muscle. In use, the side pad 142 height and angle is adjusted for the patient. The seat 136 is initially level. The patient approaches the seat so that the affected side will be on the outside of the machine away from pad 142. The patient sits on the seat and allows his legs to dangle down freely. This avoids having the patient brace the feet on the floor, and helps to provide a relaxed position. The patient then slides to the far inside of the seat until the side pad 142 is against his side and the top of the pad is several inches under the axillary region. The torso is therefore supported on the side opposite to the side being stretched. The machine 130 has no back, to avoid having the patient brace the back while stretching.

The patient is generally centered over the pivot joint 138. The patient may increase the stretch by holding onto the curved handle 150 in front of him. The patient is also able to lean forward or twist away from the side being stretched, to enhance the effects of the stretch. The patient may also lean over the side torso pad (lateral flexion away from the stretch) which puts the portion of the quadratus opposite this, on greater stretch.

The angle between the inner seat section 135 and the outer seat section 137 (e.g., 20°) helps to lean the patient against the side support 142, to promote relaxation. The seat angle also delays the upward movement of the inner seat section 135 above horizontal, as the seat 136 pivots. This helps to avoid compaction or compression of the non-stretched (inside) hip and ribs. It also enhances stability and reduces the tendency for the patient to feel that he is sliding off of the seat when the seat is titled. This helps the patient to maintain a relaxed condition. The tendency to try to shift position on the seat, in response to the tilting or pivoting, is reduced.

The patient then grasps the handle of the controller 174 with his free hand. By advancing the controller or joystick forward, the seat begins to lower the affected side. Specifically, the controller 174 causes the hydraulic cylinder 90 to retract, moving the seat 136 smoothly about the pivot joint 138. Since the inner seat 135 is angled downwards relative to the outer seat 137, it elevates less as the outer seat 137 lowers. As this occurs, the patient's back sequentially extends laterally and interiorly stretching the quadratus lumborum muscle in a controlled and relaxed manner. "Relaxed" means with little or no extrafusal muscle contraction. As the side being stretched slowly lowers, the patient determines the amount of stretch by joystick control.

When the desired range of movement is reached, the patient moves the handle control 174 the other direction, causing the hydraulic cylinder 90 to extend, pushing the seat 136 back to the horizontal position. It is preferable to pause briefly at each increase of stretch. After sufficient repetitions, the patient switches sides and repeats the process, to stretch the opposite quadratus lumborum in the other direction. FIG. 5 shows the seat in the down (stretched) position while FIG. 6 shows it in the up (start) position.

Figure 7:
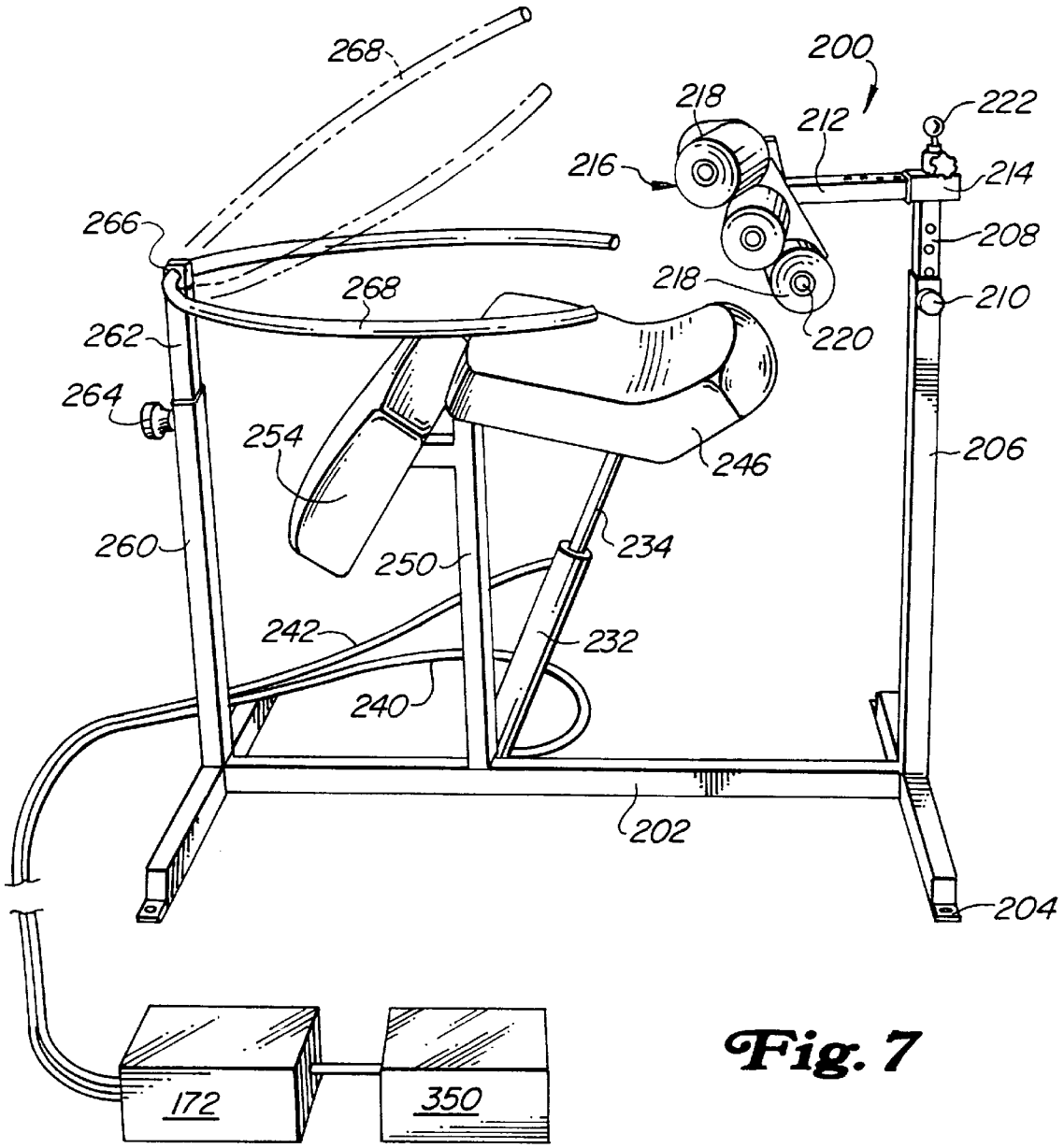
FIG. 7 is a perspective view of a third embodiment of the invention, useful, for example, for treating back extensor muscles.

Turning to FIG. 7, an embodiment 200 for treating back extensor muscles has a base 202 and floor mounting plates 204. A back support post 206 attached to the base 204 telescopically supports a back pad riser 208. The riser 208 has a plurality of vertically spaced apart holes, so that the vertical position of the back support riser 208 may be adjusted in the back support post 206 using a riser pin 210. A back pad arm 212 with through-holes extends forwardly from an arm bracket 214 attached to the back pad riser 208.

Figure 9:
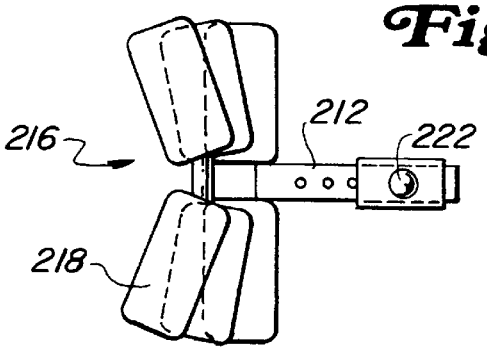
FIG. 9 is a partial top view taken along line 9—9 of FIG. 8.

Turning to FIGS. 7 and 9, a back pad assembly 216 is attached at the front end of the arm 212. The back pad assembly 216 includes padded rollers 218 supported on roller supports 220.

The front to back position of the back pad assembly 216 may be adjusted by sliding the arm 212 front or back and locking the arm in position on the bracket 214 via an arm pin 222, extending through a selected hole in the arm 212.

Figure 8:
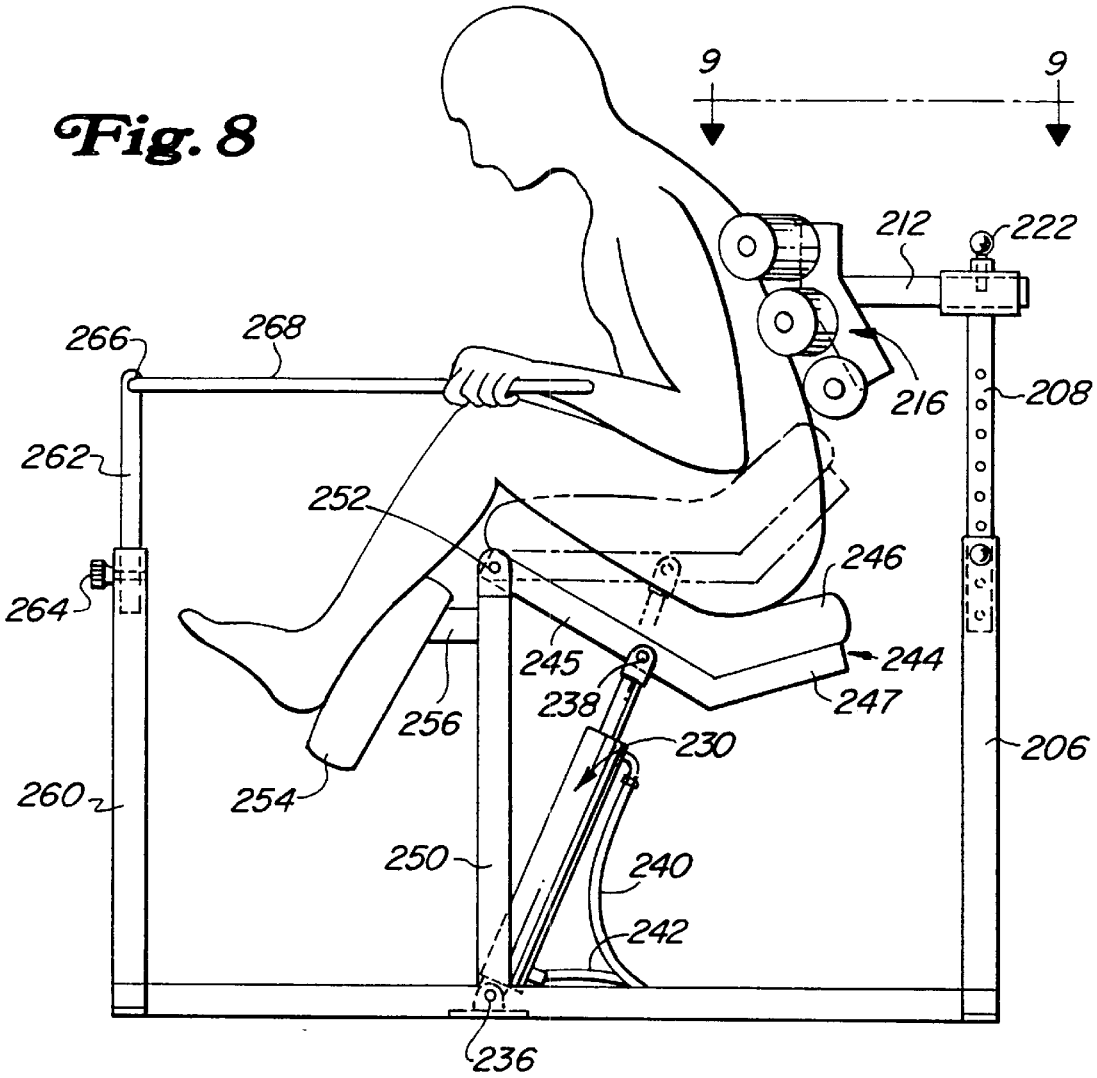
FIG. 8 is a side elevation view of the machine of FIG. 7 in use.

Turning to FIG. 8, the embodiment 200 includes an actuator 230 pivotally attached to the base 202 via a pivot 236. Hydraulic lines 240 and 242 connect to a center-balance valve in a patient hand controller (not shown) as described above with reference to FIG. 4. A seat support 244 is pivotally attached a seat post 250 extending up from the base 202 via a seat pivot 252. A seat pad 246 is attached to the seat support 244, forming a seating surface having a straight or flat inner end 245, and an upwardly angled outer end 247. The piston 234 is attached to the underside of the seat support 244 at a piston pivot 238.

A leg pad 254 is supported on a leg pad arm 256 extending perpendicularly forward from the seat post 250. The leg pad 254 preferably forms an acute angle with the seat post.

A handle bar post 260 extends upwardly from the base 202, and telescopically supports a semi-circular handle bar riser with through-holes 262 in an adjustable vertical position via a pin 264 extending through the post 260 and a selected hole in the riser 262. Referring momentarily to FIG. 7, a c-shaped handle bar 268 is attached to the handle bar riser 262 at a handle bar pivot 266, so that the handle bar 268 can pivot upwardly (as shown in phantom in FIG. 7).

In use, the patient raises the handle bar 268, sits on the seat pad 246 and then lowers the handle bar. The patient's legs rest on the leg pad 254, and the patient's back is positioned against the back pad assembly 216, with the seat in the upright and horizontal position, as shown in phantom in FIG. 8. This is the start position. The patient holds the handle bar 268 with one hand, with the other hand on the controller 174. By operating the controller, the patient causes the actuator 230 to slowly retract. As this occurs, the seat 246 slowly pivots downwardly about pivot 252. Correspondingly, the patient's torso flexes forwardly. The roller pads 218 roll upwardly on the patient's back. As shown in FIG. 9, the lower roller supports 220 are straight across, the middle set of rollers is inclined inwardly, and the top set of roller supports is inclined inwardly still farther.

After the patient has reached the maximum comfortable stretch position (which will vary from patient to patient, and will also vary for the same patient depending on various factors), using the controller 174, the patient then reverses the procedure by causing the actuator 230 to extend, thereby pivoting the seat back to its horizontal starting position.

Figure 10:
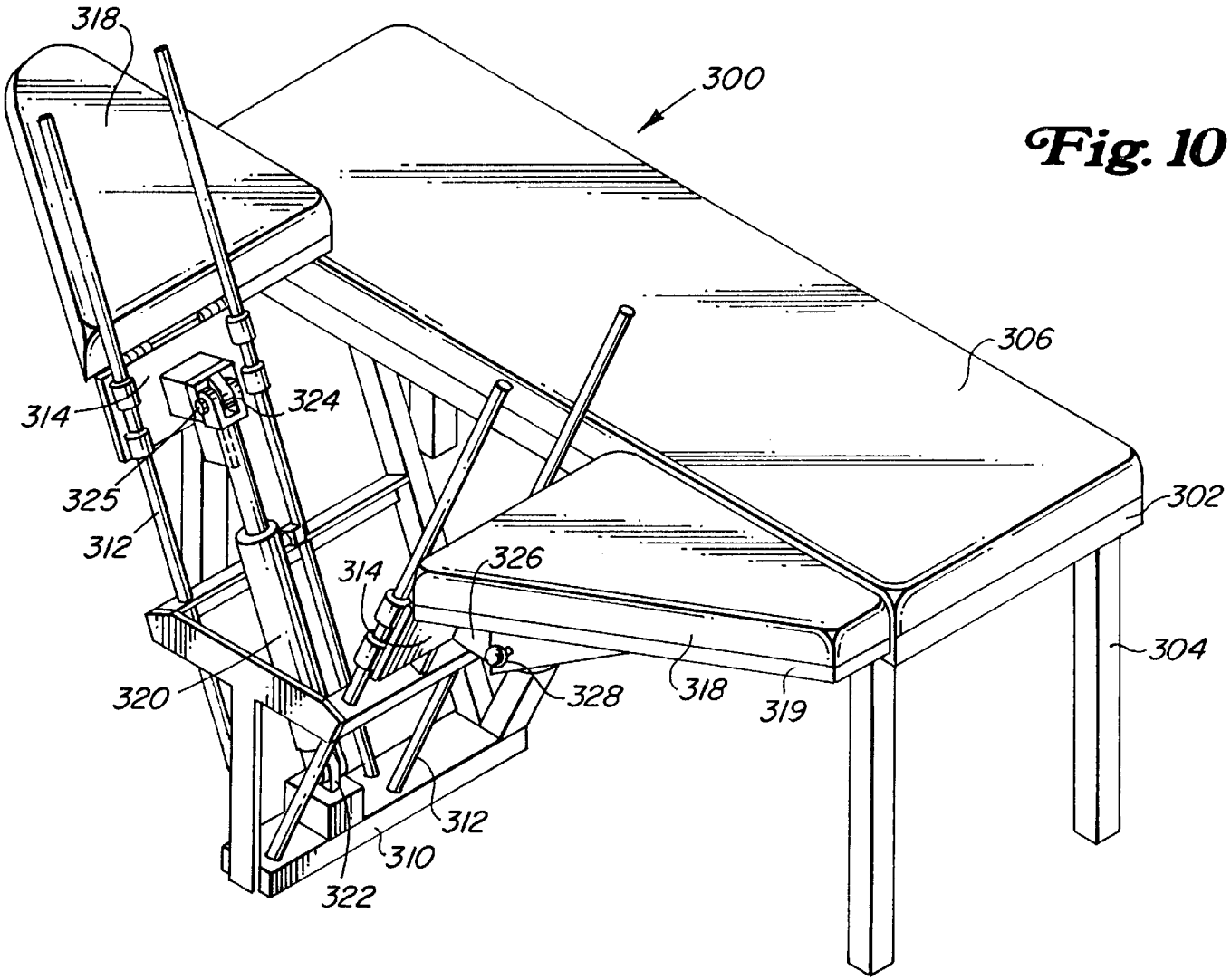
FIG. 10 is a perspective view of a fourth embodiment of the invention, useful, for example, for treating hip muscles.
Figure 11:
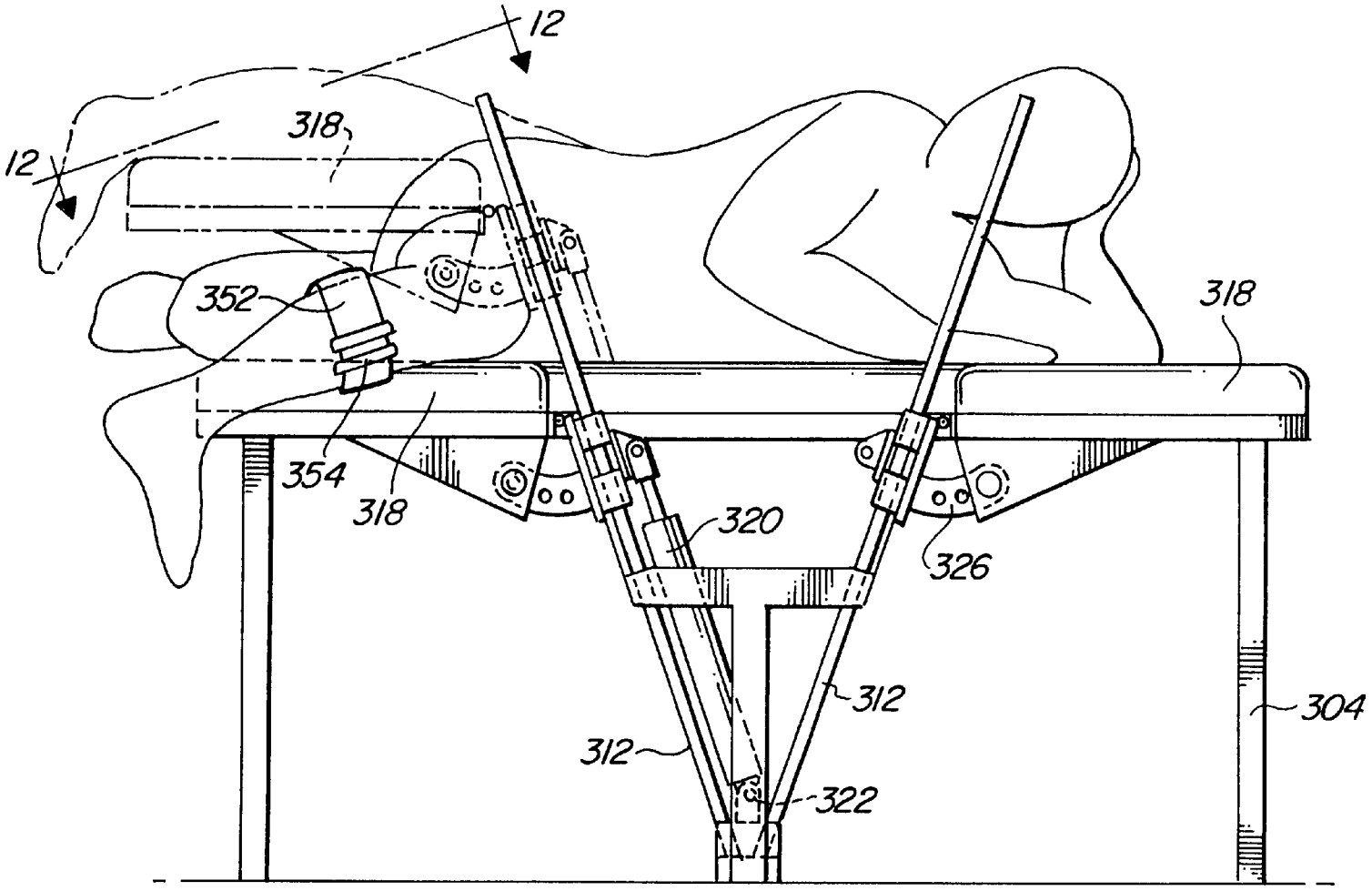
FIG. 11 is a front elevation of the machine of FIG. 10 in use.
Figure 12:
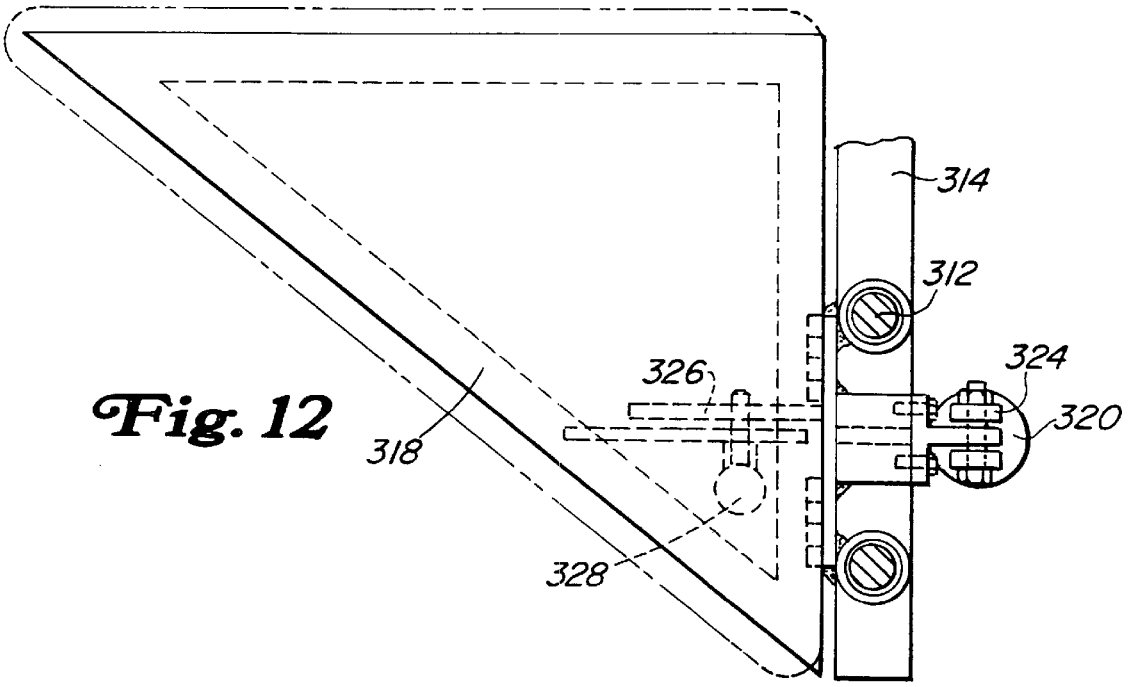
FIG. 12 is a partial plan view of the adjustable leg support taken along line 12—12 of FIG. 11.

Turning to FIGS. 10–12, in an embodiment 300 useful, for example for treating hip muscles, a frame 302 is supported on legs 304. A frame extension 310 supports movable leg pads 318 on leg frame supports 319. A frame pad 306 extends over the entire top of the frame 302. A slide plate 314 is attached to each leg pad 318 and is vertically displaceable along guide bars 312. An actuator 320 is attached to the lower end of the frame extension 310 at a lower pivot joint 322. The upper end of the actuator 320 is attached to one of the slide plates 314 at a slide plate pivot joint 324 via an attachment pin 325. The pin 325 can be quickly removed to switch the attachment of the actuator 320 from one slide plate to the other. An elevation plate 326 is attached to each slide plate 314 and extends under each leg support 319. An elevation pin 328 allows the leg frame support 319 and pad 318 to be tilted up or down about an axis parallel to the pin 328.

In use, as shown in FIG. 11, the patient lies on the frame pad 306 on his side. The patient's top leg (the right leg in FIG. 11) rests on the leg pad 318 in the elevated position, as shown in phantom in FIG. 11, with the patient's lower leg on the frame pad 306. Leg position may be improved by pivoting the frame 319 and the pad 318 with slide adjustment mount 326 down from level, and securing them in place via the locking pin 328. Using a hand controller 174, as shown and described above with reference to FIG. 6, the patient controls the actuator 320 which slowly drops the leg pad 318, e.g., to the position shown in solid lines in FIG. 11. The patient's hip and leg muscles are preferably relaxed, with all lifting performed entirely by the actuator 320. After the leg pad 318 has reached the patient's desired degree of hip stretch, the patient reverses the hand controller 174 to cause the leg pad 318 to move back up to its original position above the level of the frame pad 306. To treat hip muscles on the other side, the patient reverses position on the frame pad 306, so that the upper leg becomes DDDDthe lower leg on the opposite leg pad, and the stretching procedure repeated.

The embodiment 300 can also be used for treating shoulder muscles, i.e., the infraspinatus, teres major and rhomboid. In this application, the patient lays on the frame pad 306 face up, with patient's forearm on the leg pad 318. The movement of the leg pad, as described above, then stretches the shoulder muscles.

A computer or microprocessor controller 350, as shown in FIG. 7, may also be used to control the machines described above. The computer can be programmed to provide specific speeds and durations of stretch, thereby simplifying use of the machines by patients.

Under certain conditions, it may be preferable for the body part being treated to be weighted down. Straps 352 with weights 354 can be placed over the body part for this purpose, for example as the body part is stretched on a machine.

Various other muscles, such as the latissimus dorsi and the brachioradialis can also be stretched using the machines described herein, or with modifications that would be apparent to those skilled in the art.

Figure 13:
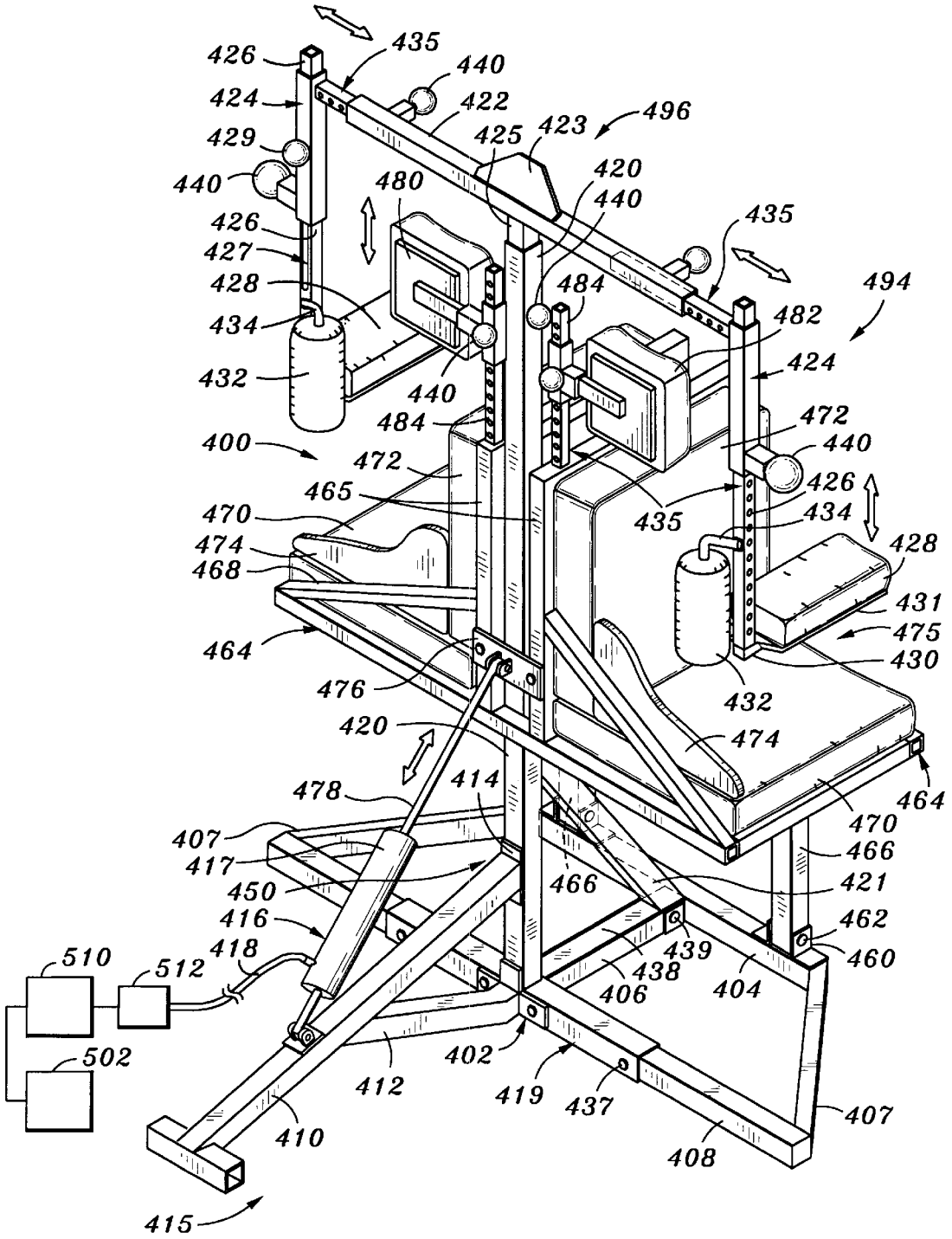
FIG. 13 is a perspective view of a fifth embodiment of the invention, useful, for example, for treating muscles in the arm, shoulder and torso.
Figure 14:
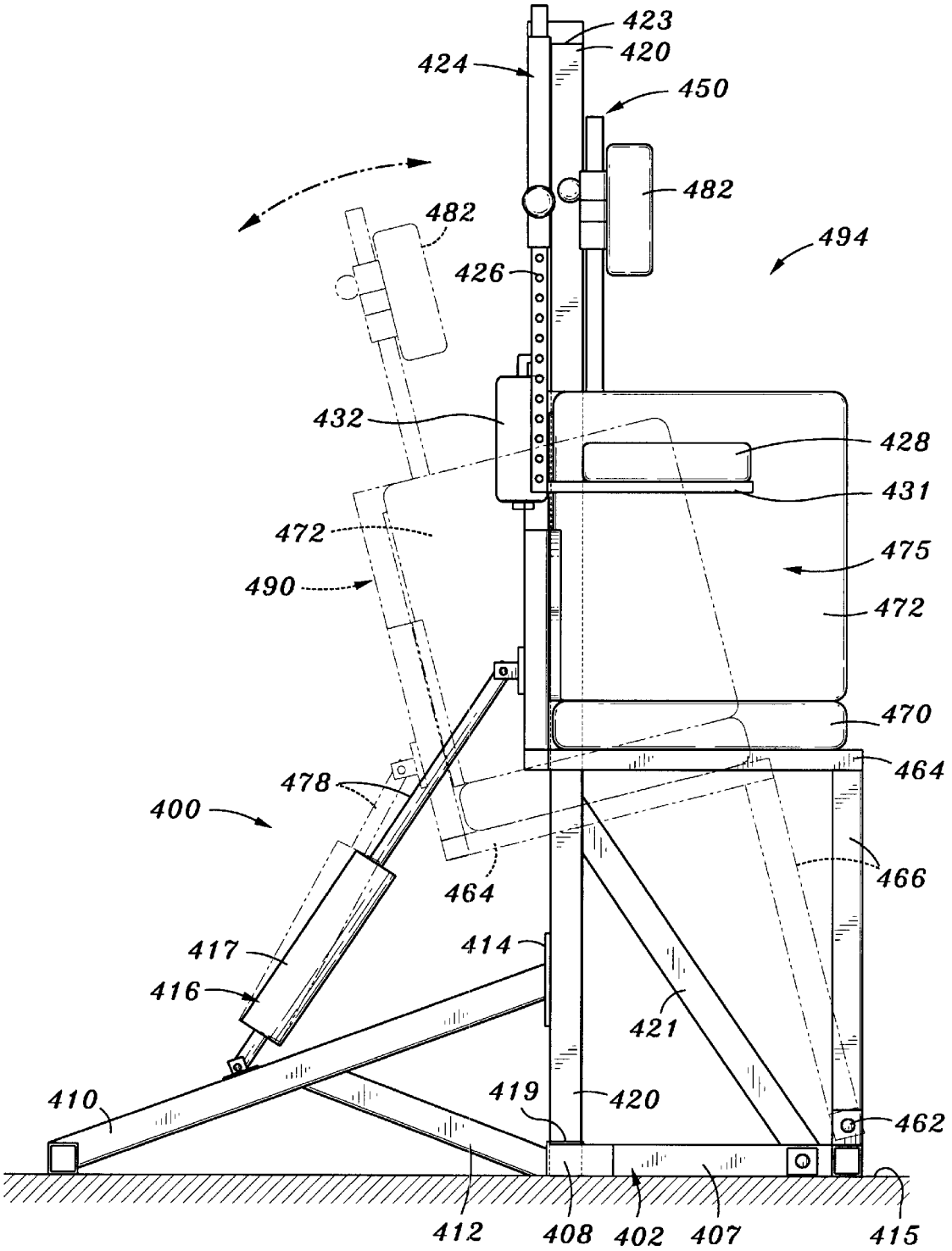
FIG. 14 is side elevation view of the machine shown in FIG. 13.
Figure 15:
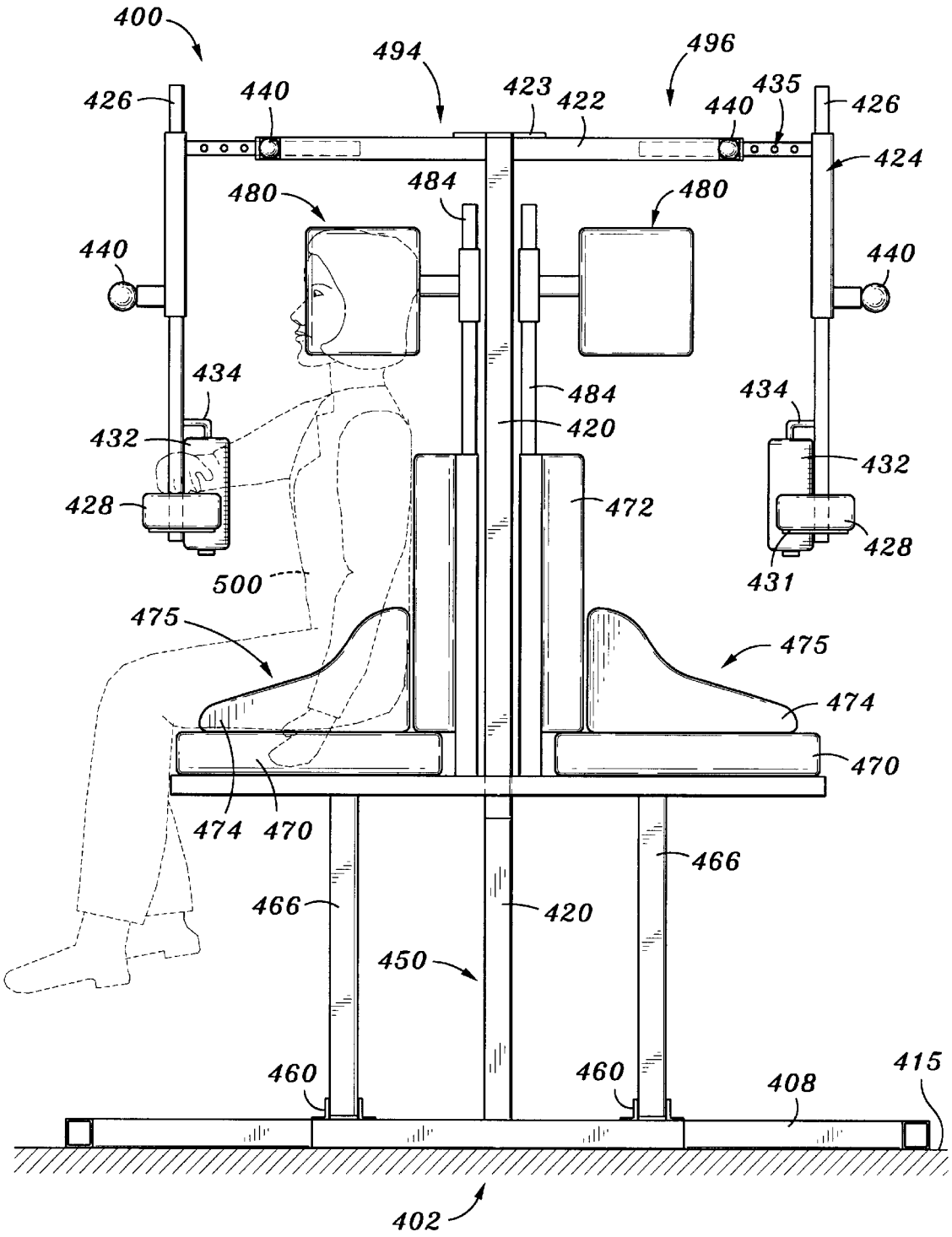
FIG. 15 is a front elevation view thereof.

Referring to FIGS. 13, 14 and 15, a fifth machine 400 is useful to allow a patient to self-stretch the muscles in the upper back, at and between the shoulder blade (scapula), muscles above and below the scapula, and muscles attached to the head of the humerus.

Referring to FIG. 13, the fifth machine 400 has a base 402 including a front leg 404 attached to a main leg 408 by a bridge 406 and outer legs 407. An upright assembly 419 is bolted to the main leg 408 and bridge 406 and has an upright post 420 which extends vertically upwardly. The upright assembly 419 includes a right angle flange 436 joined to the upright post 420 and bolted onto the main leg 408 with bolts 437. A diagonal brace 421 extends from the bridge 406 near the front leg 404 to the upright post 420, to strengthen the upright post 420 against movement. The upright assembly 419 also has a right angle sleeve 438 attached (e.g., welded) to the upright post 420 and to the diagonal brace 421. The right angle sleeve 438 overlies the bridge 406 and is bolted onto the bridge through the side tabs 439.

An actuator leg 410 is joined to the upright post 420, and extends from the upright post 420 to the floor 415. An actuator leg brace 412 extends from a generally middle area of the actuator leg and is attached to the bottom of the upright post 420. The actuator leg brace 412 may be integral (e.g., welded) to the actuator leg. The actuator leg 410 and actuator leg brace 412 are preferably attached to the upright post 420 and main leg 408, respectively, via bolts 414, so that the actuator leg 410 and actuator leg brace 412 may be removed from the upright post 420, to facilitate transport of the machine 400.

At the top of the machine 400, as shown in FIG. 13, a down tube 425 is joined to the crossbar 422 via a brace plate 423. The down tube is inserted into the upright post 420 and is vertically adjustable using an adjustment pin 440. Down bars 424 are slidably supported within the crossbar 422, on either side of the upright post 420. Similarly, an arm pad tube 426 is slidably supported within each of the down bars 424. A slot 427 is milled through the side of the arm pad tube 426. A slot bolt 429 extends through the down bar 424 and into the slot 427, to prevent the arm pad tube from contacting the patient's leg or from falling out of the down bar 424 during adjustment. The lateral positions (torso adjustments) of the down bars 424 (relative to the upright post 420) and the vertical height position of the arm pad tube 426 are adjustable via spring loaded adjustment pins 440 on the crossbar 422 and on the down bars 424, engaging position holes 435, as shown in FIG. 13. Fixed pads 432 are supported on brackets 434 attached to the arm pad tubes 426. Preferably, the fixed pads 432 can rotate. Arm pads 428 are attached to the bottom end of the arm pad tubes 426 at swivel joints 430, allowing the arm pads 428 to swivel about the arm pads tubes 426.

Figure 18A:
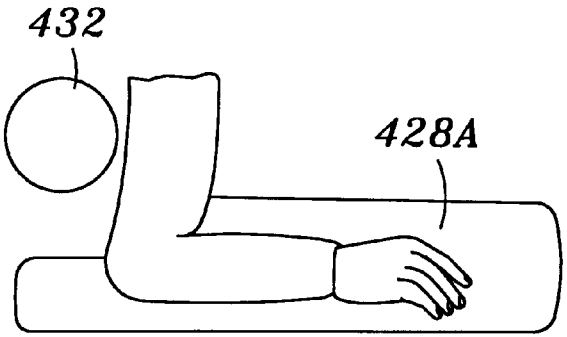
FIGS. 18A, 18B and 18C show arm pads for neutral, negative, and positive arm positioning.
Figure 18B:
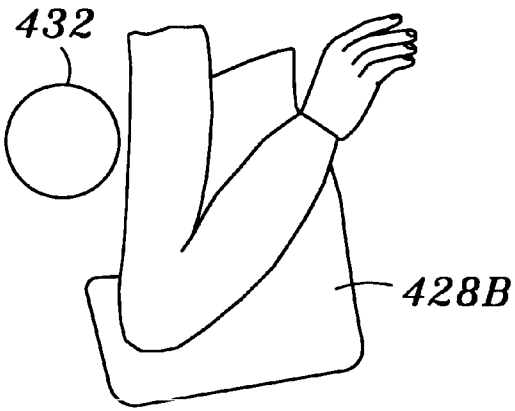
Figure 18C:
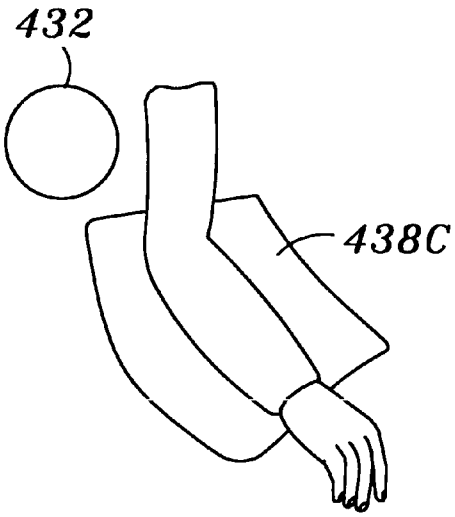

The arm pads 428 are preferably provided in three shapes 428a, 428b and 428c, as shown in FIGS. 18A, 18B and 18C, for neutral, positive and negative positioning. The arm pads are attached to the pad support 431 with Velcro or similar hook and loop material or equivalents.

Referring still to FIGS. 13, 14 and 15, the base 402, including the actuator leg 410, main leg 408, bridge 406, outer legs 407 and front leg 404, and the upright post 420, crossbar 422, and the down bars 424, form a fixed frame, generally designated as 450. The frame 450 is fixed in that, during use, the foregoing components forming the fixed frame 450 do not move.

Continuing to refer to FIGS. 13, 14 and 15, seat risers 466 are pivotably attached to the front leg 404 via a pair of spaced apart devises 460 and pivot bolts or pins 462, extending through each clevis 460 and each seat riser 466. A generally rectangular seat frame 464 is attached to the top ends of the seat risers 466, at the front of the machine 400. A pair of generally square seat back frames 465 are attached to the seat frame 464, on opposite sides of the upright post 420. Hip plate supports 468 are attached to the seat back frame 465 and seat frame 464. Seat pads 470 are secured to the seat frame 464, and seat back pads 472 are secured to the seat back frames 465, on opposite sides of the upright post 420. A padded or upholstered side or hip plate 474 is attached to each hip plate support 468.

A head rest riser 484 extends upwardly from the top back end of each seat back frame 465. A head rest 480 having a head pad 482 is mounted on each head rest riser 484. The head rest 480 is vertically adjustable on the head rest riser 484 via an adjustment pin 440 extending through a selected position hole 435 in the head rest riser 484.

The seat risers 466, seat frame 464, seat back frame 465, seat braces 468 and head rest riser 484, form a pivoting or moving frame, generally indicated as 490, as best shown in FIG. 14. As shown in FIGS. 13 and 14, the upper end of a piston 478 of an actuator 416 is pivotably attached to an actuator plate 476. The actuator plate 476 is bolted onto the seat back frames 465. The actuator 416, preferably a hydraulic actuator, is connected to a power source via a e.g., hydraulic hose 418. As best shown in FIG. 14, as the piston 478 of the actuator 416 extends and withdraws into the cylinder 417 of the actuator 416, the pivoting frame 490 pivots about the bolts or pins 462, while the fixed frame 450, and all of the components on the fixed frame remain in place.

Figure 16C:
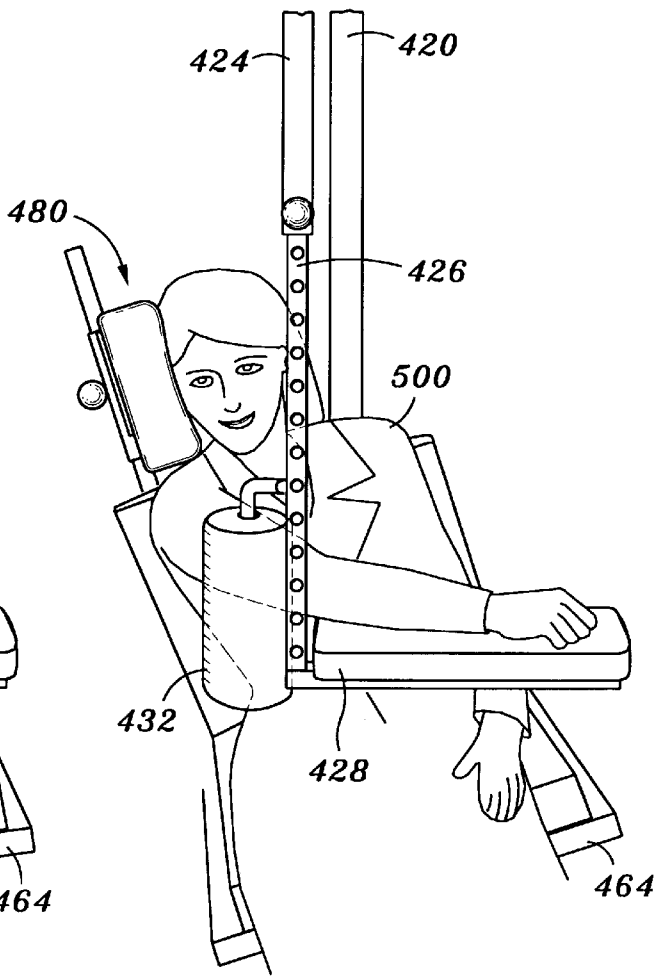
FIG. 16A, 16B, and 16C are perspective views showing the machine of FIG. 13 in use by a patient, with the patient's arm in a low position.
Figure 16B:
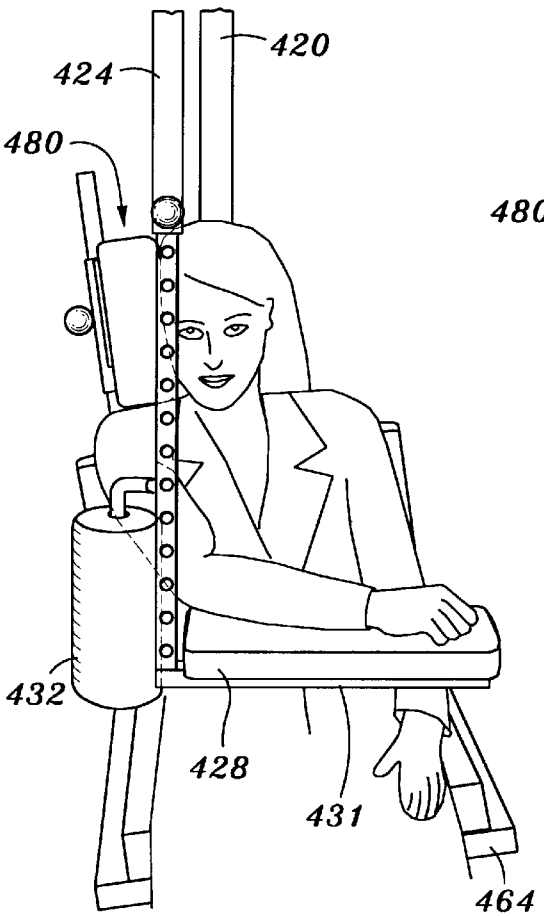
Figure 16A:
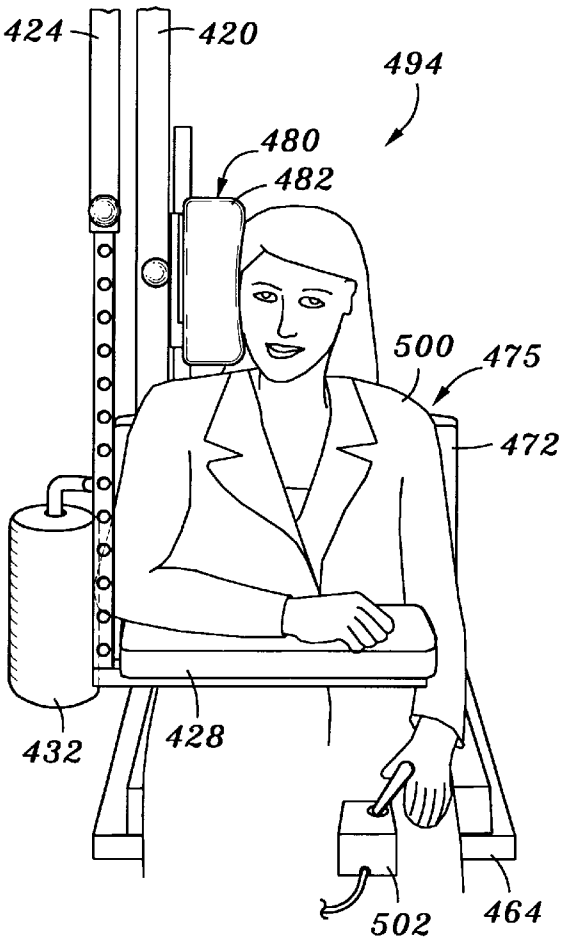

In use, as shown in FIGS. 15 and 16A, a patient 500 sits on the seat pad 470, with the patient's back against the seat back pad 472, and with the patient's head against the head pad 482. The patient's right forearm rests on the arm pad 428, as shown in FIG. 16A. The patient's right upper arm rests against the fixed but rotatable pad 432. The seat 475 formed by the seat pad 470 and seat back pad 472 is initially upright or vertical. The patient's legs are preferably dangling above the floor, as shown in FIG. 15. Using the left hand, the patient manipulates a controller 502 linked, at least indirectly, to the actuator 416. Under the patient's control, the actuator 416 retracts. This causes the entire pivoting frame 490, including the seated patient 500, to tilt or lean (e.g., to the right), as shown in FIGS. 14, 16B and 16C. As the tilting begins, the patient's head and torso move with the pivoting frame 490. However, the fixed pad 432 remains in place on the fixed frame 450. The fixed pad 432 then largely prevents the patient's right arm from freely moving with the patient's torso, as shown in FIGS. 16B and 16C. As a result, the muscles in the upper back and between the shoulder blade are stretched. The muscles begin to stretch when the pivoting frame is tilted to about 10°. Tilting and stretching may continue to about a 45° tilt, although for most patients, a 30° tilt will be sufficient. The patient controls the extent and duration of the tilting movement, and therefore of the stretch of the effected muscles, via the controller 502. As the pivoting frame 490 leans, the head pad 482 supports the patient's head. The arm pad 428 vertically supports the patient's forearm. The swivel joint 430 allows the arm pad 428 to pivot inwardly slightly, to follow the natural movement of the patient's forearm, as the patient tilts to one side. The fixed pad 432 preferably can turn on the bracket 434, so that the fixed pad can roll down slightly on the patient's upper arm, rather than rub against the upper arm, as the patient tilts.

Figure 17:
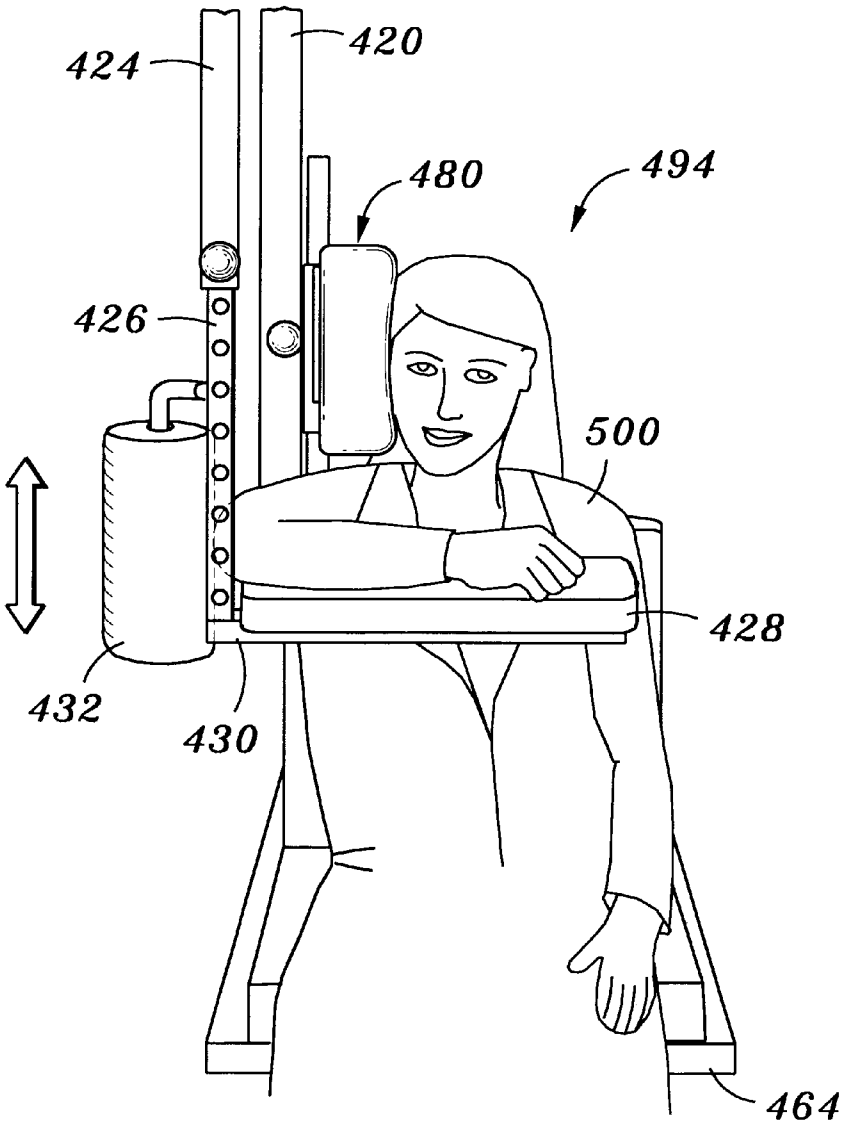
FIG. 17 is a perspective view thereof showing the patient's arm in a high position.

If the arm pad 428 is in the low position, as shown in FIGS. 16A–16C, the higher muscles in the back are stretched, including the supraspinatus and rhomboids. If the arm rest is in a middle position (between the position shown in FIG. 16A and FIG. 17), then the muscles stretched are the rhomboids and the infraspinatus. If the arm rest 428 is placed into the high position, as shown in FIG. 17 (by temporarily pulling out the spring biased adjustment pin 440 and raising the arm pad tube 426) then the muscles stretched are low in the scapular region, these muscles including latissimus dorsi and the teres major. The trapezius muscle is also generally stretched with the arm pad 428 in the high, medium or low positions.

If the forearm is positioned in a specific position on one of several removable arm rest pads, then the brachioradialis can be stretched. Alternatively the scapular stretch can be affected without stretching the brachioradialis area, for patients with painful forearm regions secondary to carpal tunnel syndrome.

After the patient 500 has completed the stretching of the patient's right arm, the patient moves from the right side seating position 494, to the left side seating position 496. Operation of the machine 400 with the patient on the left side seating position 496 is the same as on the right side seating position 494, as described above, and as shown in FIGS. 16A–C and 17. The left and right side seating positions 494 and 496 are preferably symmetrical to each other.

The machine 440 is useful for treating carpal tunnel and repetitive over-use injuries. Low back muscles are generally not stretched, although the latissimus dorsi goes down to the hip region. The patient is positioned on the seat and is relaxed throughout the treatment, without muscle contraction needed to maintain positioning. Consequently, the stretching occurs without effort by the patient, and without tensioning or muscle contraction, the stretched muscles remaining in a relaxed and uncontracted condition during stretching.

An actuator microprocessor 510 connected to a proportional valve 512 which controls fluid flow to the linear actuator 416 based on the input from the controller 502, to allow for consistent speed to be achieved, whether at initial "creeping" incremental speed or full throttle retraction of the actuator. Thus the patient always has control at constant speed, at their fingertips and can then affect the stretch to overcome the painful muscle's resistance to stretch.

To summarize, the following methods generally apply to all five machines described above. An important factor is not the actual amount of muscle elongation, but rather the release of resistance to the stretch, once a degree of elongation has been achieved. Thus, the pausing before further elongation as described above (e.g., with reference above to FIGS. 4–6), allows the muscle's resistance to stretch to decline or disappear. The patient positions himself in a relaxed state, then activates the joystick to begin a slow incremental stretch of the affected muscle. Once a sensation of stretch is experienced, the patient stops the movement and allows the muscle to release the resistance to that stretch, at which time the sensation of discomfort is relieved. The patient stays in that position until completely comfortable then activates the joystick again to produce an additional increment of stretch. If pain is felt, the patient reverses the joystick until pain is relieved. This stretching and stopping and waiting procedure continues at the patient's desired pace. When completed, the support (and the patient) return to the starting position, without the need for the patient to contract the muscle. When the actuator is at its top or bottom limit of travel, continuing to hold the controller in the up or down movement position, respectively, results in no further movement.

As is clear from the descriptions of the operations of the machines as set forth above, in performing the methods, the following steps are preferably used:

A. The actuator (and the support attached to it), as well as the muscle being treated, move in a gravity dependent direction.

B. The muscle is kept in a static state, i.e., the muscle is supported by a pad attached to the actuator.

C. Apart from the muscle being stretched (and possibly surrounding muscles), the rest of the patient's muscles are not stretched or contracted, and are unaffected by the muscle being stretched. The pad positioning system of the machines places the patient in the relaxed state. The fixed pad supports help the patient avoid contracting the muscle being stretched. The patient is positioned to eliminate stretch on all muscles including in particular any gravity produced stretch. This is accomplished by removing the pull of gravity on any body part, as any pull of gravity tends to produce a reflexive contraction of muscles to resist that pull. The patient is instructed that all muscles should be totally relaxed (non-contracting).

D. The patient has direct control over the joystick/actuator link that gives exact control over the position of the actuator/pad, and also direct control over the rate of muscle stretching.

E. The patient has direct control over the actuator/pad positioning to allow the patient to position the muscle support pad to produce a desired amount of stretch, and to hold at that position until the patient feels a release of, or overcoming the muscle's natural resistance to, stretch, while in a relaxed state. Preferably, fine fluid (hydraulic) control, in incremental slow movements, with direct positional control over the actuator/pad, provides this result.

F. The stretching is achieved purely by gravity. No force is exerted on the muscles, other than body weight.

Thus, while several embodiments and applications of the methods and apparatus of the invention have been shown and described, it will be apparent to those skilled in the art that many more modifications, substitutions, and equivalents are possible without departing from the inventive concepts herein and to treat additional muscle groups. The invention, therefore, should not be restricted, except in the spirit of the following claims.

What is claimed is:

1. A method of performing muscle therapy comprising the steps of:

seating a patient on a seat on a pivoting frame;

vertically supporting the patient's forearm on a pad;

restraining the patient's upper arm against movement; and tilting the patient and the seat.

2. The method of claim 1 further comprising the step of supporting the patient's head.

3. The method of claim 2 further comprising the step of supporting the patient's hip or torso.

4. The method of claim 1 further comprising the step of having the patient control the tilting of the seat.

5. The method of claim 1 further comprising the step of adjusting the vertical position of the pad supporting the patient's forearm.

6. A muscle therapy machine comprising:

a fixed frame supported at least indirectly on a floor surface;

a pivoting frame pivotally attached to the fixed frame;

a first seat attached to the pivoting frame;

a first arm pad attached at least indirectly to the fixed frame for supporting the patient's forearm;

a first fixed pad attached at least indirectly to the fixed frame and positioned alongside the arm pad for restraining the patient's upper arm against movement; and an actuator attached to the pivoting frame for tilting the patient and the seat.

7. The machine of claim 6 further comprising a head pad attached to the pivoting frame above the seat.

8. The machine of claim 6 further comprising a second seat attached to the pivoting frame, and a second arm pad and a second fixed pad attached to the fixed frame and associated with the second seat.

9. The machine of claim 8 wherein the first seat faces in a first direction and the second seat faces in a second direction opposite to the first direction.

10. The machine of claim 6 wherein the actuator is retractable to move the pivoting frame from an upright position wherein the first seat is horizontal, to an inclined position, wherein the first seat is at an inclined angle.

11. The machine of claim 6 wherein the fixed upper arm pad is rotatably attached to the fixed frame.

12. The machine of claim 6 wherein the first arm pad is pivotally attached to the fixed frame.

13. A muscle therapy machine comprising:

a fixed frame;

a pivoting frame attached to the fixed frame at pivot joints;

a pair of back to back seats, with each seat having a seat bottom and a head support attached to the pivoting frame, and a forearm support, and an upper arm support attached to the fixed frame; and an actuator attached to the fixed frame and to the pivoting frame.

* * * * *